United States Patent [19]

Gansewig

[11] 4,284,273

[45] Aug. 18, 1981

[54] APPARATUS FOR RAKING AND LEVELLING SAND IN A PIT

[76] Inventor: Otto H. J. Gansewig, Tegelkuhl 10, 2053 Schwarzenbek, Fed. Rep. of Germany

[21] Appl. No.: 109,453

[22] Filed: Jan. 3, 1980

Related U.S. Application Data

[63] Continuation of Ser. No. 846,130, Oct. 27, 1979, abandoned, which is a continuation of Ser. No. 619,252, Oct. 3, 1975, abandoned.

[30] Foreign Application Priority Data

Oct. 14, 1974 [DE] Fed. Rep. of Germany ..... 2448830

[51] Int. Cl.[3] ..... A63B 5/00

[52] U.S. Cl. ..... 272/101; 172/26; 172/197

[58] Field of Search ..... 272/100, 101; 172/145, 172/150, 680, 170, 180, 179, 198, 199, 200, 697, 767, 770, 197, 26

[56] References Cited

U.S. PATENT DOCUMENTS

| | | | |
|---|---|---|---|
| 68,224 | 8/1867 | Minor | 172/26 X |
| 318,048 | 5/1885 | Smith | 172/26 X |
| 362,011 | 4/1887 | Judson et al. | 172/198 |
| 620,655 | 3/1899 | Hutchinson | 172/197 |
| 623,759 | 4/1899 | Baker | 172/150 X |
| 984,497 | 2/1911 | Barnard | 172/145 X |
| 1,223,625 | 4/1917 | Settle | 172/200 X |
| 1,257,818 | 2/1918 | Dixon | 172/199 |
| 1,440,323 | 12/1922 | Wheeler | 172/26 X |
| 2,997,115 | 8/1961 | Moser | 172/199 X |
| 3,264,667 | 8/1966 | Frank | 172/26 X |
| 3,613,802 | 10/1971 | Garlson | 172/197 |

FOREIGN PATENT DOCUMENTS

| | | | |
|---|---|---|---|
| 1725841 | 2/1954 | Fed. Rep. of Germany . | |
| 2114727 | 10/1972 | Fed. Rep. of Germany | 172/101 |
| 550670 | 1/1943 | United Kingdom . | |
| 620648 | 3/1949 | United Kingdom . | |
| 796250 | 6/1958 | United Kingdom . | |
| 928519 | 6/1963 | United Kingdom . | |
| 932550 | 7/1963 | United Kingdom . | |
| 1036943 | 7/1966 | United Kingdom | 172/548 |
| 1337124 | 11/1973 | United Kingdom | 172/123 |

*Primary Examiner*—Richard J. Johnson
*Attorney, Agent, or Firm*—Stevens, Davis, Miller & Mosher

[57] ABSTRACT

Apparatus for raking and levelling sand in a pit comprises a frame which is arranged to be movable over the pit on guides or rails and carries a skimming device associated with a rake consisting of at least one row of blades or tines. The blades or tines rake the sand and the skimming device levels it. The frame may also carry a roller arranged to roll the levelled sand.

4 Claims, 6 Drawing Figures

APPARATUS FOR RAKING AND LEVELLING SAND IN A PIT

This is a continuation of application Ser. No. 846,130 filed Oct. 27, 1979, now abandoned, which in turn is a continuation of application Ser. No. 619,252 filed Oct. 3, 1975, now abandoned.

BACKGROUND OF THE INVENTION

The invention relates to an apparatus for horizontally levelling the surface of sand present in a pit, more particularly in a jumping pit for light athletics.

In jumping pits at light athletics centres, the sand is smoothed manually with a rake after the jump and the subsequent measuring process. The surface of the sand in the pit is then required to be levelled as flat and horizontally as possible, especially in the normal landing zone. It is obvious that non-horizontal smoothing of the surface may give rise to inaccuracies in the determination of the distance jumped. Furthermore, the landing causes a region of the sand in the pit to become consolidated, and unless this region is loosened up sufficiently it is possible for regions with loose sand and regions with firmer sand to be immediately juxtaposed in the landing zone.

In the event of a landing in such a transition zone, sand from the looser region may trickle into the depression formed by the jump and impressions may thus be produced which do not conform to the impressions of the actual jump, so that in the final effect an incorrect jumping distance is measured.

The same problems exist not only with jumping pits, but also with pits for such activities as putting the shot.

The object of the invention is to level horizontally the surface of a pit filled with sand.

SUMMARY

The invention provides an apparatus for horizontally levelling the surface of sand present in a pit, more particularly in a jumping pit for light athletics, which comprises a skimming device having a horizontal edge section which comes into contact with the sand, and a rake associated with the skimming device, the skimming device and the rake being movable across the surface of the pit.

According to a preferred embodiment of the apparatus the rake comprises two rows of tines, the tines of the rows being staggered laterally with respect to one another and arranged at an angle to the direction of movement. A skimmer bar is located behind the two rows of tines. The skimmer bar and rake are fixed conjointly to supports which are movable on track surfaces on both sides of the pit. The bar itself or the supports are adjustable so that the edge of the skimmer bar can be made horizontal. Lastly, also in a preferred embodiment, a control means is provided whereby the skimmer bar and rake can be moved reciprocatingly across the pit so that the sand is worked through more than once by the tines, and during the last return movement is smoothed by the edge so that a flat horizontal surface results.

With the aid of the apparatus according to the invention, sand in a pit is worked through uniformly and a horizontal surface of the sand is created simultaneously. No lumps or consolidations whatsoever are possible in the sand, so that a definite horizontal surface exists for each jump and the distances actually jumped can be determined more accurately than hitherto.

The invention further has the aim, more particularly in the case of a jumping pit for light athletics, to work through and smooth the marginal region of the landing zone. It is thereby intended to achieve that the sand which is displaced outwards by the jump is restored back into the landing zone.

This is achieved in that the tines or blades of the rake are distributed non-uniformly across the width of the apparatus, that is the individual tines have unequal mutual intervals, or else few tines or none at all are provided in the region where landing is not to be expected, and the tines have short mutual intervals in the zone where landings are to be expected. Furthermore, the tines in the region of the landing zone may be of prolonged construction so that they protrude more deeply into the sand of the jumping pit in order to work through the sand there particularly. The skimmer bar may be constituted by a plurality of sections, whereof certain sections are aligned in a line at right-angles to the working direction and other sections are arranged at an angle to that line.

A particularly advantageous embodiment is that in which two regions are provided with sections arranged at an angle to the perpendicular to the working direction, and between these regions parts are present in the marginal region of the landing zone which are aligned at an angle to the perpendicular to the working direction. Lastly, a roller may be provided in front of the rake or of the skimmer bar, which is arranged above the surface of the sand during the forward movement of the apparatus and which is lowered during the return movement of the apparatus in order to level minor irregularities in the surface of the sand. In order to adjust the surface of the sand in the pit in the desired manner, the roller may be mounted in its bearings adjustably at right-angles to the surface of the pit.

DESCRIPTION OF THE PREFERRED EMBODIMENT

Figure 1:
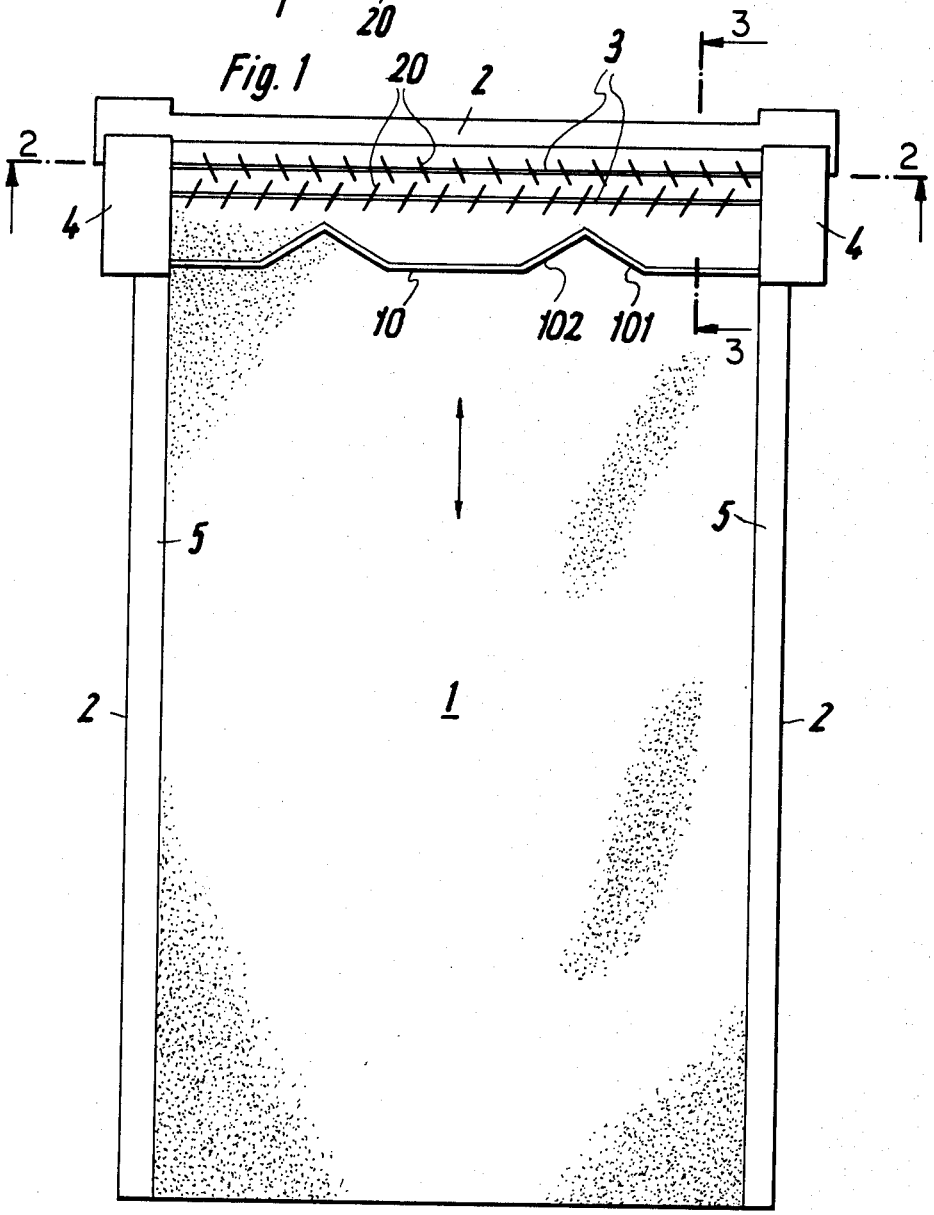
FIG. 1 is a plan of a pit and shows schematically an apparatus according to the invention.

FIG. 1 shows a jumping pit 1, which is of rectangular shape and is constituted by a U-shaped frame 2. Quartz sand or the like is contained within the frame 2. The top surface of the frame 2, more particularly at the longitudinal sides of the pit, are provided with track surfaces 5. The track surfaces are aligned horizontally and serve as a foundation for movable supports 6 on both longitudinal sides of the pit 1.

Figure 2:
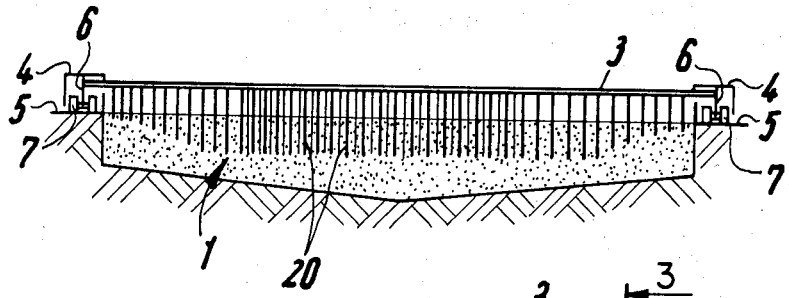
FIG. 2 is a sectional view made along the line 2—2 of FIG. 1.

FIG. 2 illustrates schematically the frame supports 6 on both sides of the pit. The supports 6 are provided with rollers 7 or the like which can roll on the track surfaces 5. There is also fastened to the supports 6 a frame 3 which extends from one side to the other of the pit 1. The frame 3 may be fastened rigidly in the supports 6, but it is also possible to construct the fastening means adjustably so that the frame can be varied in its horizontal position. Downwardly projecting tines or blades 20 are fastened to the frame 3. It will be seen from FIG. 2 that the blades 20 in the central region are each of the same length and thus project equally deeply into the sand of the pit. At the two longitudinal sides of the pit the blades 20 do not project so deeply into the pit as do the blades of the central region, instead the length of the blades is made to decrease from that in the central region to that at the edge of the pit. A casing 4 fits over the ends of the frame 3, supports 6 and rollers 7.

Figure 3:
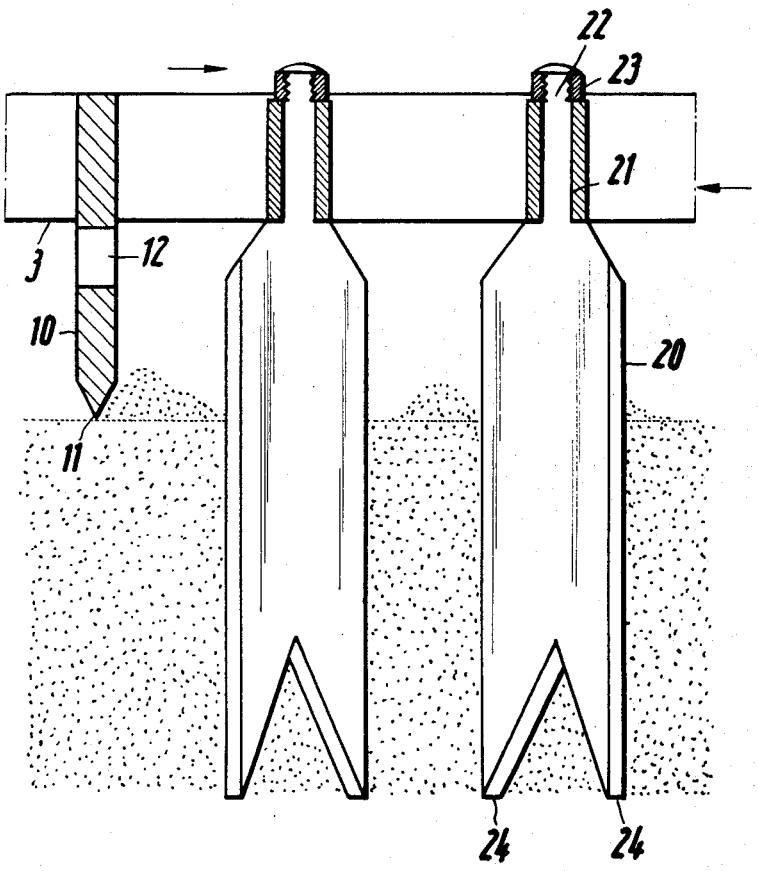
FIG. 3 is a sectional view made along the line 3—3 of FIG. 1.
Figure 4:
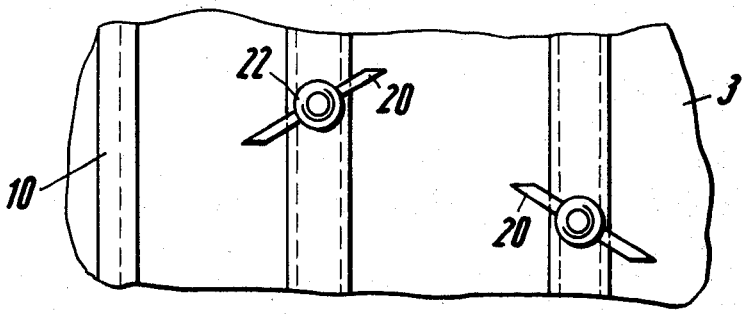
FIG. 4 is a plan relating to FIG. 3.
Figure 5:
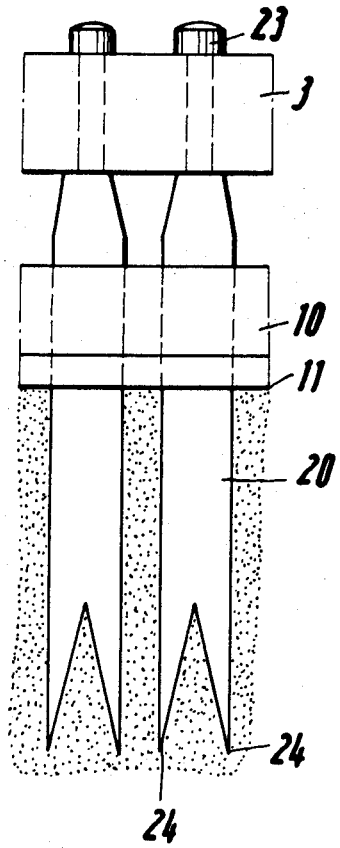
FIG. 5 is a elevation relating to FIG. 3.

FIG. 3 shows in section a part of the frame 3 from which two blades 20 project vertically downwards into the sand of the pit. The blades 20 may be curved in shovel shape or be made of rectangular cross-section and be provided at their top ends with a screw thread 22 which projects upward through the frame 3 when the blades 20 are inserted so that a nut 23 can be screwed onto the screw thread. The shank of the blade 20 at the top end of which the screw thread 22 is present, passes through the frame, a sleeve 21 being arranged between the shank and the frame 3. By this means it is possible to adjust the blade 20 and to bring it into a position as illustrated in FIG. 4. The edge section 10 of a skimming device is located in front of the two rows of blades 20. The edge section has substantially a rectangular cross-section and is fastened by its top end in the frame 3. The fastening of the edge section 10 can be made in such a way that its bottom convergent ridge 11 can be made horizontal. The edge section 10 is of perforated construction so that sand can pass through a hole or a passage 12, so as to prevent sand from accumulating in front of or behind the edge section. It will be seen from FIGS. 3 and 5 that spikes or jags 24 are present on the blades in their lower region.

During use of the apparatus according to the invention, the frame 3 is moved across the pit 1 so that first of all the edge section 10 is moved across the unsmoothed surface of the sand.

The blades 20, which are arranged staggered laterally and in rows to one another, are then passed through the sand and can loosen the latter and rake it through. During return movement, the sand is once more worked through by the blades, but the ridge of the edge section 10 arranged in the horizontal direction smooths the surface so that a uniform surface of the sand in the pit is created. By control means this process of reciprocating movement of the skimming device and of the rake can be repeated so that a flat surface, and also uniformly worked sand without consolidated spots can be obtained in the pit.

The top surface of the sand in the pit which is obtained by a process of movement of the edge section and of the rake can be controlled with the aid of a light barrier which is arranged behind the edge section in the direction of the return movement and initiates a fresh work process in case accumulations of sand are detected by the light barrier.

The apparatus according to the invention can be moved reciprocatingly by hand, but it can also be moved reciprocatingly by wheels driven by electric motors, lastly it is also possible to move the supports manually or by means of a motor through a rope tackle.

Figure 6:
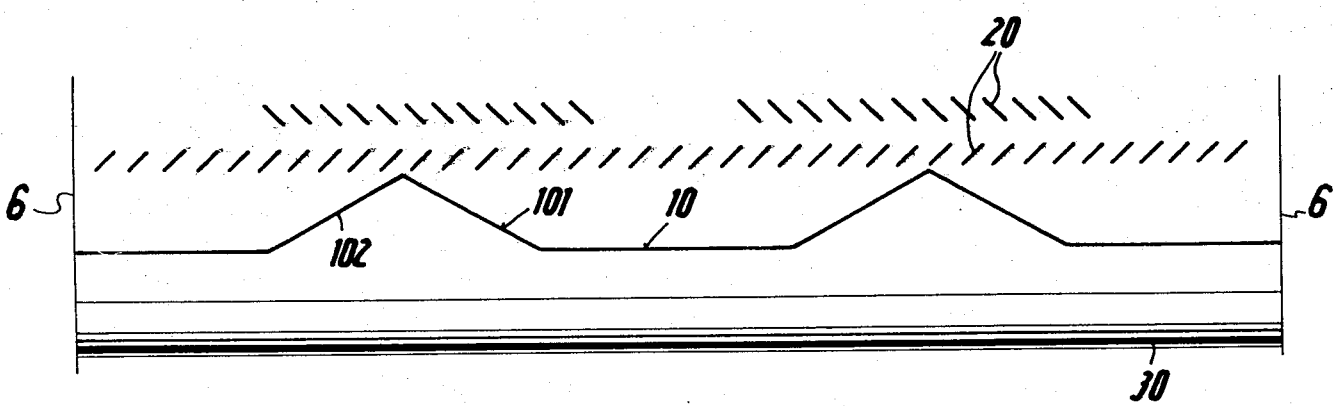
FIG. 6 shows a top plan view of a modified apparatus according to the invention.

In FIG. 6 the supports 4 of the apparatus according to the invention are illustrated schematically with their lateral boundaries. Between the supports, two rows of blades or tines 20 are present which are arranged in mutually opposite senses of their oblique positioning. The rear row (shown at the top in FIG. 6) comprises a few tines 20 arranged mutually at an interval, whilst no tines are provided outside and in the centre. The row of tines located in front thereof is characterised by tines arranged approximately at equal mutual intervals. In front of the tines is the skimmer bar 10 which comprises a plurality of sections, whereof the outer sections and the central section are aligned in one line. Between these sections aligned in one line are sections 101 and 102 lying outside that line on the left hand half and on the right hand half of the apparatus respectively.

Lastly, FIG. 6 shows a roller designated 30 which is mounted at a short interval in front of the edge section 10. This is a cylindrical roller which is mounted rotatively in the supports and can be adjusted in height manually.

When the apparatus according to the invention moves forwards, the roller 30 is maintained at such a height that it has no contact with the sand present in the pit. When the working direction of the apparatus according to the invention is reversed and the apparatus moves backwards, the roller 30 is lowered to such a height that its lower boundary just comes into contact with the surface of the sand in the pit. Small particles such as sand lumps and stones can be forced into the surface of the sand by the roller.

I claim:

1. Apparatus for horizontally aligning the surface of sand contained in a rectangularly shaped pit, particularly of a jumping pit, comprising guide means composed of two parallel elements aligned horizontally with respect to each other, said elements positioned on opposite longitudinal sides of said pit, a frame horizontally mounted on rollers extending between said guide means and reciprocally movable on said guide means, a perforated skimming device mounted longitudinally on said frame constituted by a plurality of sections wherein at least one section is aligned at right angles to the direction of movement of the frame and at least two sections are arranged at an angle to the alignment of said one section, said sections having a horizontal edge section converging into a ridge to contact sand in the pit and a rake mounted longitudinally on said frame constituted by two rows of transversely staggered blades with a wide side of each blade at an angle to the direction of movement of the rake, said blades of the two rows being aligned with mutually opposite angles mounted on said frame, said blades in each row being positioned at spaced intervals.

2. The apparatus according to claim 1, wherein each blade defines two spikes extending therefrom.

3. The apparatus according to claim 1, wherein the spaced interval between the blades of the rake is less in the central region of the rake than in the end regions of the rake.

4. The apparatus according to claim 1, including a horizontal roller mounted on said frame in front of the rake and skimming device.

* * * * *